US010273615B2

(12) United States Patent
Cerliani

(10) Patent No.: US 10,273,615 B2
(45) Date of Patent: Apr. 30, 2019

(54) HOOK FOR LOCKSTITCH SEWING MACHINE COMPRISING AT LEAST ONE TENSION SPRING TO CREATE A STABLE TENSION OF THE BOBBIN THREAD

(71) Applicant: CM CERLIANI S.R.L., Pavia (IT)

(72) Inventor: Daniele Cerliani, Pavia (IT)

(73) Assignee: CM CERLIANI S.R.L., Pavia (IT)

( * ) Notice: Subject to any disclaimer, the term of this patent is extended or adjusted under 35 U.S.C. 154(b) by 579 days.

(21) Appl. No.: 14/802,303

(22) Filed: Jul. 17, 2015

(65) Prior Publication Data

US 2016/0040341 A1 Feb. 11, 2016

(30) Foreign Application Priority Data

Aug. 5, 2014 (IT) ..... MI2014A1430

(51) Int. Cl.
*D05B 57/14* (2006.01)
*D05B 57/26* (2006.01)
*D05B 63/00* (2006.01)

(52) U.S. Cl.
CPC ..... *D05B 57/143* (2013.01); *D05B 57/14* (2013.01); *D05B 57/26* (2013.01); *D05B 57/265* (2013.01); *D05B 63/00* (2013.01)

(58) Field of Classification Search
CPC ..... D05B 57/08; D05B 57/14; D05B 57/143; D05B 57/26; D05B 57/265; D05B 63/00
USPC ..... 112/228, 229, 181, 184, 230, 231
See application file for complete search history.

(56) References Cited

U.S. PATENT DOCUMENTS 2,299,524 A * 10/1942 Chason ..... D05B 57/26 112/231
2,495,637 A * 1/1950 Joseph ..... D05B 57/143 112/228
2,839,019 A * 6/1958 Werle ..... D05B 57/143 112/228
3,140,681 A * 7/1964 Corey ..... D05B 57/14 112/228

(Continued)

FOREIGN PATENT DOCUMENTS

CH 658 273 A5 10/1986
DE 10035819 C1 11/2001
IT 1325819 7/2001

OTHER PUBLICATIONS

Italian Search Report, dated Mar. 23, 2015, from corresponding Italian Application.

(Continued)

*Primary Examiner* — Danny Worrell
(74) *Attorney, Agent, or Firm* — Young & Thompson

(57) ABSTRACT

Hook (11, 12, 13, 14) for a lockstitch sewing machine, or parts of the hook such as the support element of the tension spring (in particular the basket or the bobbin case) or the tension spring itself, including a tension spring (80, 90, 100, 110, 120) that includes a bending towards the outside (with respect to the support element on which it is mounted and with respect to the main bending radius of the tension spring) of the tension spring's extremity designed to press on the bobbin thread, so that the pressure point (P) on the bobbin thread is the point of tangency between the bending radius (R) of the bending of the tension spring's extremity and the support element of the tension spring, so as to generate a stable tension of the bobbin thread.

12 Claims, 13 Drawing Sheets

(56) References Cited

U.S. PATENT DOCUMENTS 3,921,551 A * 11/1975 Gustmann ..... D05B 57/14 112/181
3,921,553 A * 11/1975 Gustmann ..... D05B 57/14 112/228
3,940,089 A * 2/1976 Lindquist ..... B65H 59/04 242/156
4,089,282 A * 5/1978 Cerliani ..... D05B 57/26 112/229
4,157,691 A * 6/1979 Cerliani ..... D05B 57/26 112/229
4,235,178 A * 11/1980 Ackermann ..... D05B 57/26 112/229
4,284,017 A * 8/1981 Starr ..... D05B 57/26 112/181
4,365,567 A * 12/1982 Kuhar ..... D05B 59/00 112/184
4,434,734 A * 3/1984 Russell ..... D05B 57/26 112/181
4,530,296 A * 7/1985 Takenoya ..... D05B 63/00 112/229
4,638,751 A * 1/1987 Hanyu ..... D05B 63/00 112/229
5,048,436 A * 9/1991 Thiele ..... D05B 57/14 112/228
RE33,879 E * 4/1992 Shimizu ..... D05B 57/26 112/231
5,109,782 A * 5/1992 Uyama ..... D05B 57/143 112/184
5,152,236 A * 10/1992 Hirose ..... D05B 57/14 112/231
5,375,544 A * 12/1994 Badillo ..... D05B 57/26 112/231
5,651,323 A * 7/1997 Hirose ..... D05B 57/16 112/231
5,960,728 A * 10/1999 Hirose ..... D05B 57/14 112/231
6,076,477 A * 6/2000 Badillo ..... D05B 57/14 112/231
6,152,057 A * 11/2000 Badillo ..... D05B 57/26 112/229
6,895,879 B1 * 5/2005 Kronenberger ..... D05B 57/14 112/229
6,901,871 B1 6/2005 Kronenberger
9,797,077 B2 * 10/2017 Cerliani ..... D05B 57/143
2003/0167989 A1 * 9/2003 Lee ..... D05B 57/26 112/231
2010/0126398 A1 * 5/2010 Suzuki ..... D05B 57/26 112/229
2010/0126399 A1 * 5/2010 Cerliani ..... D05B 57/14 112/231
2012/0222598 A1 * 9/2012 Tseng ..... D05B 57/26 112/231
2014/0245937 A1 * 9/2014 Cerliani ..... D05B 57/14 112/231
2016/0040341 A1 * 2/2016 Cerliani ..... D05B 57/143 112/229
2016/0230321 A1 * 8/2016 Cerliani ..... D05B 57/143

OTHER PUBLICATIONS

International Standard: Textiles—Stitch types—Classification and terminology, International Organization for Standardization, ISO 4915 Second Edition, Aug. 1, 1991, pp. i-48.

* cited by examiner

HOOK FOR LOCKSTITCH SEWING MACHINE COMPRISING AT LEAST ONE TENSION SPRING TO CREATE A STABLE TENSION OF THE BOBBIN THREAD

FIELD OF THE INVENTION

The present invention relates to a hook for lockstitch sewing machine (with one needle thread and a bobbin thread), both of the rotary type and of the central bobbin type (known also as shuttle), and both for domestic and industrial use, which includes a tension spring improved compared to the state of the to make the thread tension during the sewing operation more constant and less sensitive to the type and diameter of the bobbin thread The invention further relates to a lockstitch sewing machine comprising such a hook comprising such a tension spring improved compared to the state of the art to make the thread tension during the sewing operation more constant and less sensitive to the type and diameter of the bobbin thread.

BACKGROUND OF THE INVENTION

The improved tension spring can be used in place of the known tension spring, which depending on the executions is mounted on the bobbin case in case of a central bobbin hook, and on the bobbin case or directly on the basket in case of a rotary hook.

The rotary hook can be of the type with horizontal axis of rotation or of the type with vertical axis of rotation.

Lockstitch sewing machines and related central bobbin hooks or rotary hooks are well known and therefore will not be described here, limiting just to remember schematically their composition.

The central bobbin hook comprises a hook body on which is bound the bobbin case that contains the bobbin on which the bobbin thread is wound. The bobbin thread is threaded through the guiding holes of the bobbin case and is made to pass between the tension spring mounted on the bobbin case and the bobbin case itself, so as to create a tension on the thread during the unwinding of the same for the sewing operation. This tension can be adjusted by turning the adjusting screw of the tension spring.

Quite similar is the operation of the bobbin case—bobbin system in the rotary hooks, where the tension spring is always mounted on the bobbin case to create the tension of the bobbin thread, similarly as described for the central bobbin hook. The difference though is that on the rotary hooks, in execution with bobbin case, the bobbin case is constrained to the basket housed inside the hook body, instead directly to the hook body.

On the rotary hooks in execution without bobbin case, on the other hand, the bobbin is housed directly in the basket and the tension spring that creates the tension on the bobbin thread, is mounted on the basket and the bobbin thread is threaded through the guiding holes of the basket and is made to pass between the tension spring mounted on the basket and the basket itself so as to create a tension on the thread during the unwinding for the sewing operation. This tension can be adjusted by turning the adjusting screw of the tension spring.

Beyond where the tension spring is mounted (on the bobbin case or on the basket) its operating principle is always the same: the tension spring is formed by a thin metal sheet of a thickness generally between 0.2 mm and 0.5 mm, of elongated shape with a major axis a few times longer than the minor axis and bent appropriately at arch along its major axis, so as to press the bobbin thread on the wall of the support means on which the tension spring itself is mounted (respectively the bobbin case or the basket), thus creating a friction on the bobbin thread, which is then put under tension during unwinding for the sewing operation. The pressure with which the tension spring presses on the bobbin thread can be adjusted through an adjusting screw. Acting on this adjusting screw and varying the pressure, the bobbin thread tension is varied for the sewing. The tension spring is mounted on its support means (respectively the bobbin case or the basket) by means of said adjusting screw and a fastening screw or, alternatively to said fastening screw, by an interlocking system on the support means. Important for the thread tension's stability is the contact point between the tension spring and the bobbin thread. In the standard state of the art execution, this contact point is located on the edge of the tension spring. In absence of the bobbin thread it is in fact natural that the arch shaped bend of the tension spring leads said tension spring to rest on the support means, on which it is mounted, along the extremity of the tension spring that is on the edge of the sheet that constitutes it. In a second implementation (actually very rare), instead, the contact point is set back with respect to this edge and is determined by the point of tangency of the arc of bending of the tension spring and the profile of the support means on which the tension spring is mounted. In this case, however, it is much more difficult to identify with certainty the contact point, and it is much more difficult to keep constant the repeatability of such assembly during the mass production of the tension spring, which is always a thin bent metal sheet and as such presents discrete machining tolerances.

The first case, namely that of the pressure point corresponding to the edge of the tension spring's sheet is universally used and has the advantage of an easy realization. A first drawback, however, is constituted by the tension of the bobbin thread that is not stable (i.e. has oscillations) during the sewing operation as it is very dependent to the irregularities of the thread itself: pulling the thread by hand gives the feeling that the tension spring "scratches" the thread. This effect is much more evident with certain types of threads, such as those more rough and those of poor quality and is much more annoying when the sewing requires a low tension of the bobbin thread, as it causes irregularities in the closure of the stitch. A second disadvantage of this execution occurs when, at the change of the type of bobbin thread, also the tension generated by the pressure of the tension spring changes. Consequently, at each change of bobbin thread type is necessary to re-adjust the pressure, acting on the adjustment screw. This effect is obviously more inconvenient in applications that need a frequent change of the bobbin thread type, as occurs in household and handicraft activities.

The second case, namely that of the pressure point corresponding to the point of tangency of the arc of bending of the tension spring and the profile of the support means on which it is mounted, in part fixes the first mentioned disadvantage, as it reduces the fluctuations of the tension and reduces the tension's sensitivity to the irregularities and roughness of the bobbin thread. However, changing the diameter of the bobbin thread, also the pressure point can change, thus changing the tension. The main disadvantage of this second case, however, is given by the difficulty of mass production of such a tension spring and by a poor repeatability from one tension spring to another. These factors generate a much higher cost of production, in addition to a remaining intrinsic uncertainty concerning the exact point of pressure.

The U.S. Pat. Nos. 6,152,057 and 6,901,871 patents disclose a tension system in which the bobbin thread is wrapped at least partially around the element that generates the tension. The tension of the bobbin thread is therefore obtained by friction of the bobbin thread on the element that generates the tension.

The U.S. Pat. No. 6,895,879 patent describes a tension spring with a different section between the portion on which acts the adjustment screw and the portion on which the tension spring presses the thread. The purpose is to have a greater flexibility of the portion on which the tension spring presses the thread.

The CH-A-658 273 patent refers to a shuttle for textile machines and embroidery machines comprising a cover on which is fixed a flat spring arranged parallel on the cover and apt to give tension to the bobbin thread.

SUMMARY OF THE INVENTION

Purpose of the present invention is to provide a hook comprising a tension spring easy to produce, economic at least as the standard state of the art tension spring, but that creates a much more stable bobbin thread tension (i.e. with low fluctuations) during the sewing operation, as it is not subject to the irregularities of the thread itself: pulling the thread by hand must not give the feeling that the tension spring "scratches" the thread, but the thread must exit "smoothly". A second advantage of the present invention occurs when, changing the type of bobbin thread, no or only a minimal difference of the tension occurs. Therefore, the change from one type of bobbin thread to another does not any more require to re-adjust the pressure of the tension spring by turning the adjusting screw.

Substantially, the hook according to the invention comprises a tension spring, mounted on the basket or on the bobbin case, which creates a friction on the bobbin thread independent as much as possible from the irregularities and from the characteristics of the thread, such as for example size, material, processing and surface roughness. In the following we indicate these better performances of the tension spring as more stable tension.

In a preferred embodiment, this more stable tension is achieved by a bending towards the outside (with respect to the support means on which it is mounted and with respect to the main bending radius of the tension spring) of the tension spring's extremity, so that the pressure point is no longer the edge of the spring, but the point of tangency of the radius of said bending of the tension spring's extremity. In this preferred embodiment, said bending radius of the tension spring's extremity is opposite to the main bending radius of the tension spring (which is bent towards the inside of the support means on which it is mounted), and is of very restrained size (typically of an order of magnitude less than the main bending radius of the tension spring).

In another preferred embodiment, the flat development of the tension spring's sheet, is extended in the proximity of the extremity of the tension spring designed to press on the bobbin thread, so to make possible to bend such excess material with a bending radius towards the outside (with respect to the support means on which the tension spring is mounted and with respect to the main bending radius of the tension spring) and to leave unchanged the contact point of the tension spring with the bobbin thread. The advantage, however, is constituted by the fact that while with the execution according to the state of the art, in this point falls the edge of the sheet of the tension spring, in the present invention, instead, in said point falls the point of tangency of the bending radius of the extremity.

In another preferred embodiment, said bending radius towards the outside of the extremity of the tension spring, opposite to the main bending radius of the tension spring (which is bent towards the inside of the support means on which it is mounted), is of a very small size and is less than 2 mm.

An advantage of the hook object of the present invention is constituted by the fact that it can be applied to all existing sewing machines without having to modify their stitching mechanism and without requiring any modification to a sewing machine available on the market, as a hook designed according to the invention is completely interchangeable with a conventional hook and possesses all the constructional features necessary to implement the invention.

Also the bobbin case or, respectively, the basket comprising the described tension spring, are object of the present invention and one of their advantage is that they can be mounted on all existing hooks without having to modify the hook and without requiring any changes to the hooks available on the market, as the bobbin case or, respectively, the basket made according to the invention are completely interchangeable with a bobbin case or, respectively, a basket, as they are known, and possess all the constructional features necessary to implement the invention.

Also the described tension spring is the object of the present invention and one of its advantage is the fact that it can be mounted on all the hooks, bobbin cases and baskets without having to modify the existing hooks, bobbin cases or baskets available on the market, as the tension spring according to the invention is completely interchangeable with a known tension spring and possesses all the constructional features necessary to implement the invention.

BRIEF DESCRIPTION OF THE DRAWINGS

The invention will now be described with reference to exemplary embodiments, but not limiting, described in the attached figures, where.

DETAILED DESCRIPTION OF THE INVENTION

In the attached figures, corresponding elements will be identified by the same numeral references.

Figure 1:
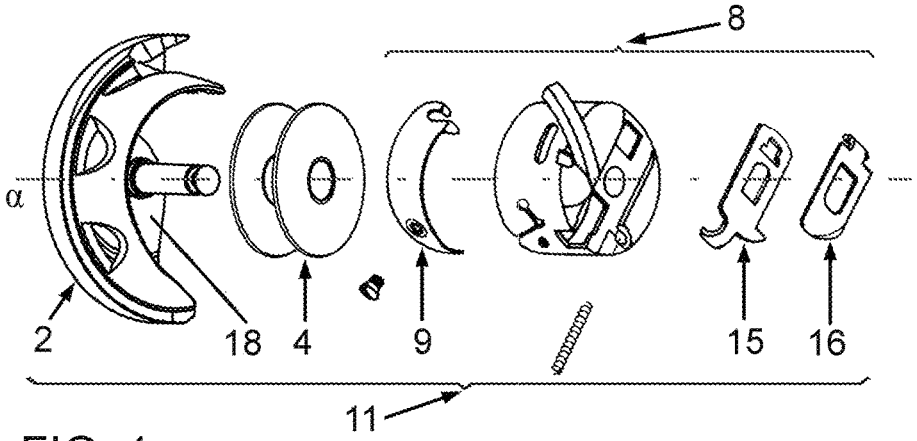
FIG. 1 PRIOR ART
FIG. 1 shows schematically an exploded view of a central bobbin hook, complete with bobbin case, known.

FIG. 1 shows schematically an exploded view of a central bobbin hook 11 with horizontal axis "α" of rotation, known, in which only the elements relevant to the present description have been identified by numeral references:

- a hook body 2, comprising a well 18 in which the bobbin case 8 complete with bobbin 4 is housed;
- a support means of the tension spring, in this case a bobbin case 8 housed in the well 18 of the hook body 2, free to rotate inside of the hook body 2 and complete with latch slide 15 for the axial constraint of the bobbin case 8 on the hook body to prevent accidental disassembly during the sewing operation, and complete with the latch lever 16 that acting on the latch slide 15 allows the operator to disengage the slide 15, and herewith the bobbin case 8, from the axial constraint on the hook body 2 to allow the removal of the bobbin case, and complete with tension spring 9 to give tension to the bobbin thread (whose graphical representation is omitted) wound on the bobbin 4 which is inside the bobbin case 8;
- a bobbin 4, on which is wound the bobbin thread (not shown), is housed in the bobbin case 8 and is constrained within the hook body 2 by the mounting of the bobbin case 8 on the hook body 2.

Figure 2:
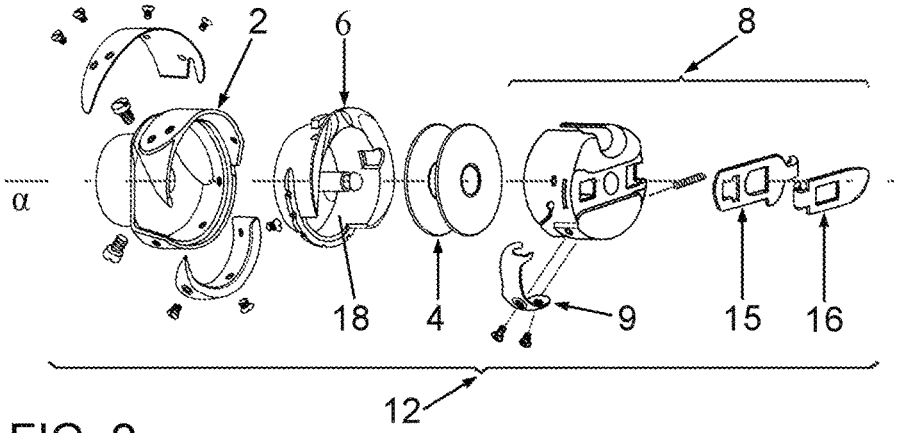
FIG. 2 PRIOR ART
FIG. 2 shows schematically an exploded view of a rotary hook with horizontal axis, complete with bobbin case, known.

FIG. 2 shows schematically an exploded view of a rotary hook 12 with horizontal axis "α" of rotation, known, in which are identified by numeral references only the elements relevant for the purposes of the present description:

- a hook body 2;
- a basket 6, free to rotate inside of the hook body 2 comprising: a well 18 of the basket 6 in which is housed the bobbin case 8 complete with bobbin 4;
- a support means of the tension spring, in this case a bobbin case 8 housed in the well 18 of the basket 6, complete with latch slide 15 for the axial constraint of the bobbin case 8 on the basket to prevent accidental disassembly during the sewing operation, and complete with the latch lever 16 that acting on the latch slide 15 allows the operator to disengage the slide 15, and herewith the bobbin case 8, from the axial constraint on the basket 6 to allow the removal of the bobbin case, and complete with tension spring 9 to give tension to the bobbin thread (whose graphical representation is omitted) wound on the bobbin 4 which is inside the bobbin case 8;
- a bobbin 4, on which is wound the bobbin thread (not shown), is housed in the bobbin case 8 and is constrained within the basket 6 by the mounting of the bobbin case 8 on the basket 6.

Figure 3:
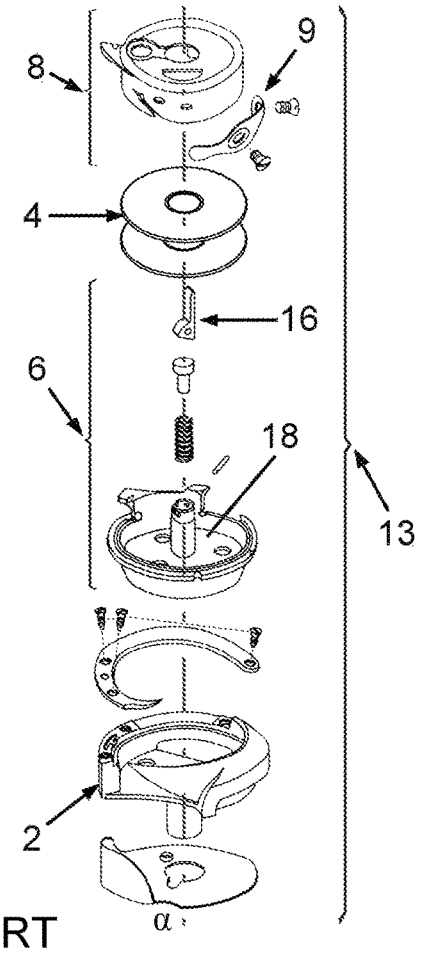
FIG. 3 PRIOR ART
FIG. 3 shows schematically an exploded view of a rotary hook with vertical axis, complete with bobbin case, known.

FIG. 3 shows schematically an exploded view of a rotary hook 13 with vertical axis "α" of rotation, known, in which are identified by numeral references only the elements relevant for the purposes of the present description:

- a hook body 2;
- a basket 6, free to rotate inside of the hook body 2 comprising: a well 18 of the basket 6 in which is housed the bobbin case 8 complete with bobbin 4; a lever 16 that allows the operator to disengage the bobbin case 8, from the axial restraint on the basket 6 to remove the bobbin case 8;
- a support means of the tension spring, in this case a bobbin case housed in the well 18 of the basket 6, complete with tension spring 9 to give tension to the bobbin thread (whose graphical representation is omitted) wound on the bobbin 4 which is inside the bobbin case 8;
- a bobbin 4, on which is wound the bobbin thread (not shown), is housed in the bobbin case 8 and is constrained within the basket 6 by the mounting of the bobbin case 8 on the basket 6.

Figure 4:
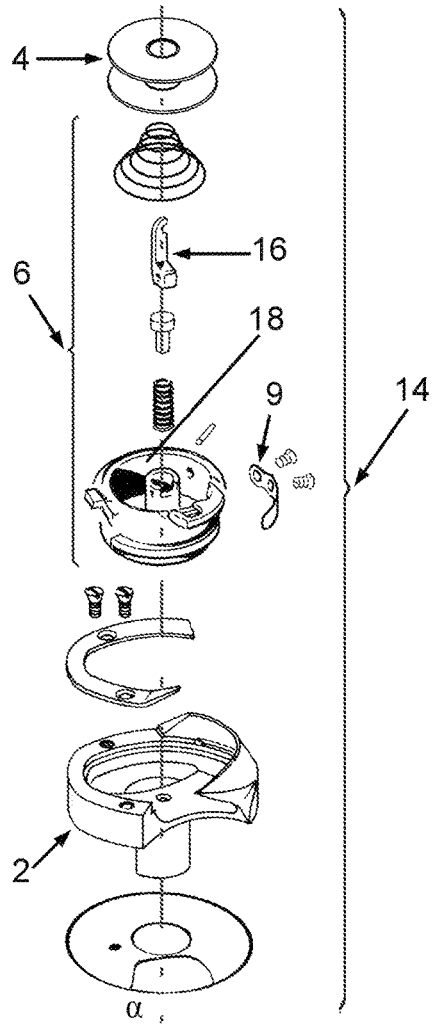
FIG. 4 PRIOR ART
FIG. 4 shows schematically an exploded view of a rotary hook with vertical axis, in the execution without bobbin case, known.

FIG. 4 shows schematically an exploded view of a rotary hook 14 with vertical axis "α" of rotation, in execution without bobbin case, known, in which are identified by numeral references only the elements relevant for the purposes of the present description:

- a hook body 2;
- a support means of the tension spring, in this case a basket 6, free to rotate inside the hook body 2, comprising: a well 18 of the basket 6 in which is housed the bobbin 4, a lever 16 that allows the operator to disengage the bobbin 4 from the axial constraint on the basket 6 to allow the removal of the bobbin, and a tension spring 9 to give tension to the bobbin thread (whose graphical representation is omitted) wound on the bobbin 4;
- a bobbin 4, on which is wound the bobbin thread (not shown), housed inside the basket 6.

FIGS. 5*a*-5*c*, 6*a*-6*c* and 7*a*-7*c* show different tension springs in the version according to the state of the art in a perspective view a) and in a side view b), with the detail c) zoomed and in section according to the axis A-A to highlight the pressure point P of the tension spring on the bobbin thread.

The hook 11, 12, 13, 14 object of the present invention, comprises a tension spring, mounted on the basket or on the bobbin case, which creates a stable tension on the bobbin thread and independent as much as possible from the irregularities and from the characteristics of the thread.

In a preferred embodiment of a hook 11, 12, 13, 14 according to the invention, described in FIGS. 8*a*-8*c*, 9*a*-9*c* and 10*a*-10*c*, the tension spring designed to create such a stable tension comprises a bending towards the outside (with respect to the support means on which it is mounted and with respect to the main bending radius of the tension spring) of the extremity of the tension spring, so that the pressure point is no longer the edge of the tension spring's sheet, but the point of tangency of the radius of said bending extremity of the tension spring. In this preferred embodiment, said bending radius of the tension spring's extremity is opposite to the main bending radius of the tension spring (which is bent towards the inside of the support means on which it is mounted), and is of very small size (typically of an order of magnitude less than the main bending radius of the tension spring).

FIGS. 8*a*-8*c*, 9*a*-9*c* and 10*a*-10*c* show a first preferred embodiment of the present invention. In the version according to the state of the art, the tension spring (50, 60, 70) comprises an edge at its extremity, which generates the pressure point P on the bobbin thread. In the execution according to said first preferred embodiment of the present invention, the tension spring (80, 90, 100) comprises a bending towards the outside at its extremity, whose bending radius R is designed to press on the bobbin thread.

FIGS. 11*a*-11*c* and 12*a*-12*c* show a second preferred embodiment of the present invention. As said, in the version according to the state of the art, the tension spring (50) comprises an edge at its extremity, which generates the pressure point P on the bobbin thread. In the version according to said second preferred embodiment of the present invention, the tension spring (110, 120) comprises an extension of the flat development of the tension spring's sheet, in the proximity of the extremity of the tension spring designed to press on the bobbin thread, so as to make possible to bend such excess material (111, 121) towards the outside (with respect to the support means on which the tension spring is mounted and with respect to the main bending radius of the tension spring) with a bending radius R and to leave unchanged the contact point of the tension spring with the bobbin thread. Quite evident corresponding extensions can be realized for the other embodiments of the tension spring according to the state of the art (60, 70), for which the representation is omitted.

Figure 5B:
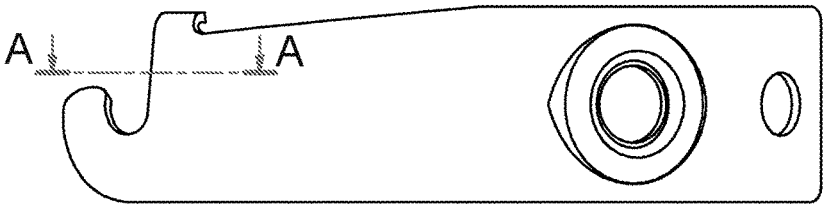
FIG. 5b PRIOR ART
FIGS. 5*a*-5*c*, 6*a*-6*c* and 7*a*-7*c* show some of the embodiments of the tension spring according to the state of the art.
Figure 5C:
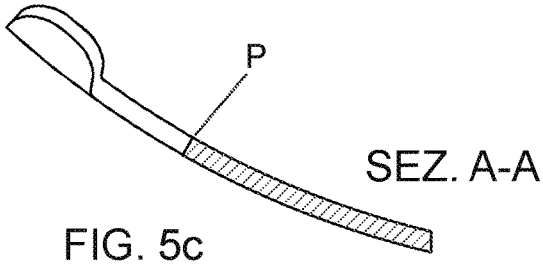
FIG. 5c PRIOR ART
Figure 5A:
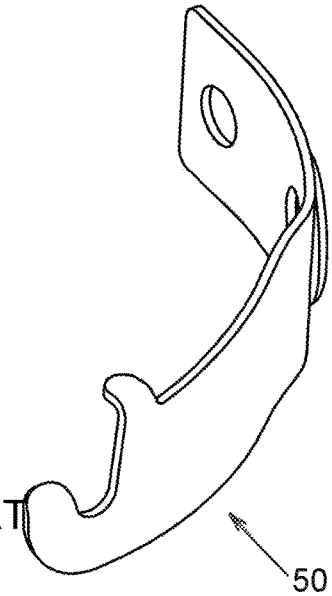
FIG. 5a PRIOR ART
Figure 6B:
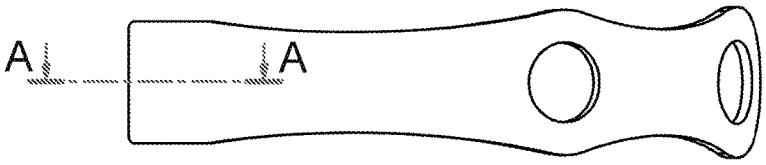
FIG. 6b PRIOR ART
Figure 6C:
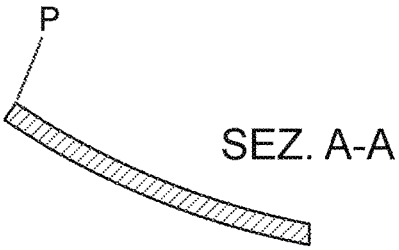
FIG. 6c PRIOR ART
Figure 6A:
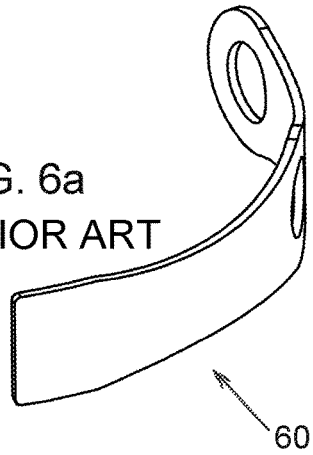
FIG. 6a PRIOR ART
Figure 7B:
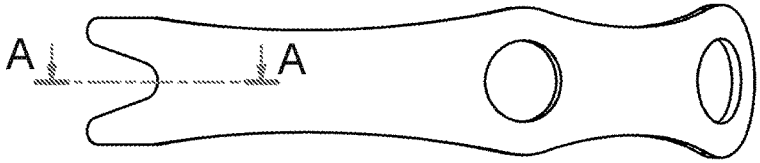
FIG. 7b PRIOR ART
Figure 7C:
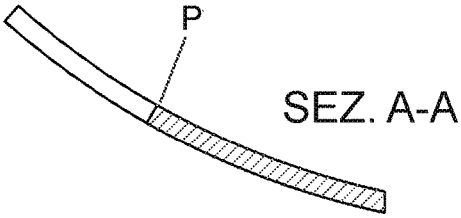
FIG. 7c PRIOR ART
Figure 7A:
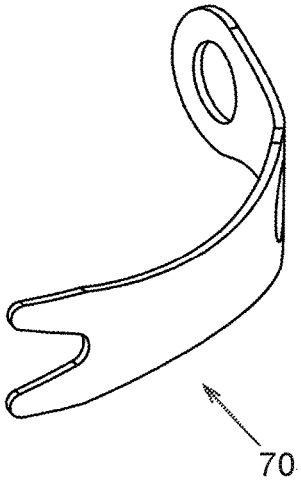
FIG. 7a PRIOR ART
Figure 8B:
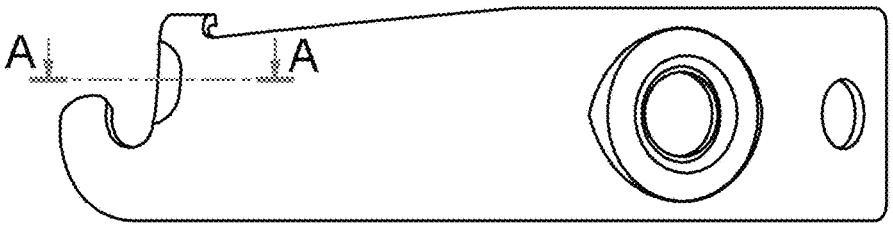
FIGS. 8*a*-8*c*, 9*a*-9*c* and 10*a*-10*c* show a kind of embodiment of the tension springs of FIGS. 5*a*-5*c*, 6*a*-6*c* and 7*a*-7*c* according to the invention, presenting a bending towards the outside (with respect to the support means on which it is mounted and with respect to the main bending radius of the tension spring), of the extremity of the tension spring, so that the pressure point on the bobbin thread is no longer the edge of the tension spring's sheet, but the point of tangency of the bending radius of said extremity.
Figure 8C:
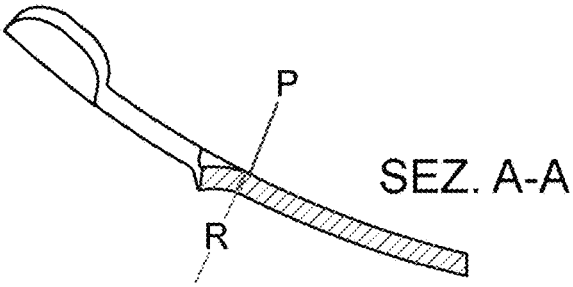
Figure 8A:
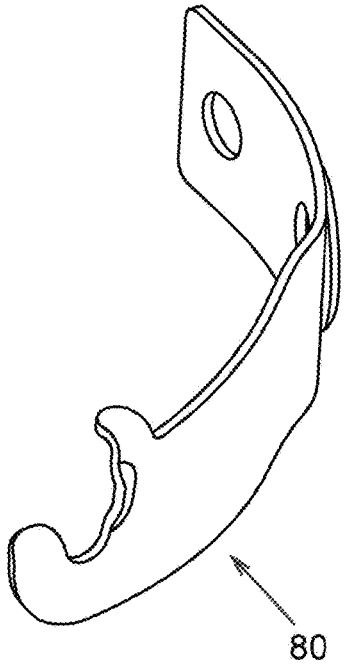
Figure 9B:
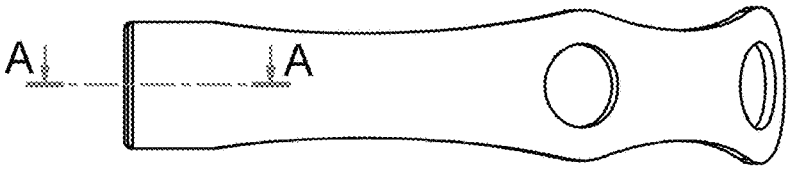
Figure 9C:
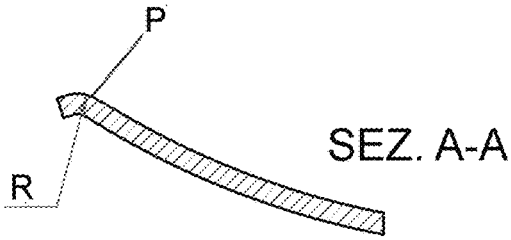
Figure 9A:
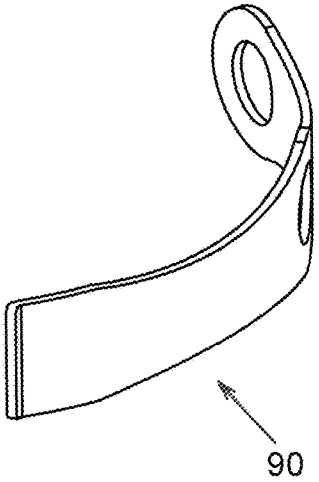
Figure 10B:
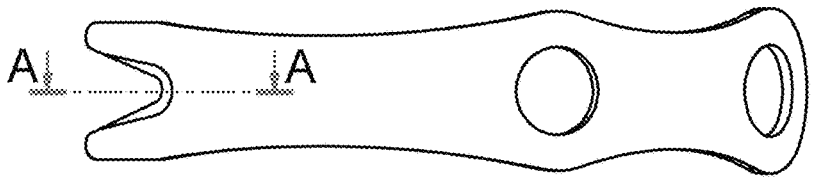
Figure 10C:
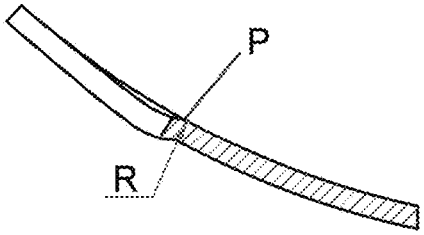
Figure 10A:
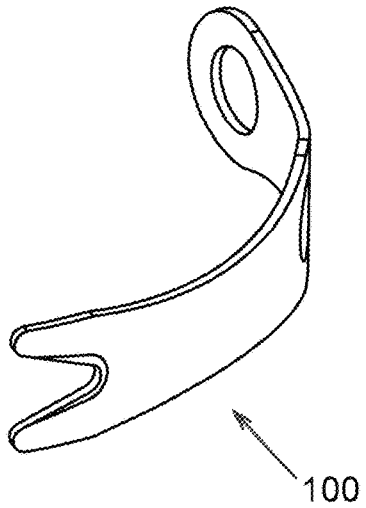
Figure 11B:
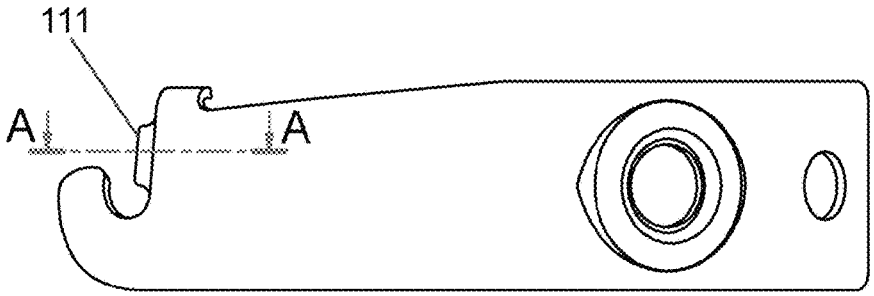
FIGS. 11*a*-11*c* and 12*a*-12*c* show a different embodiment of the tension spring of FIGS. 8*a*-8*c* according to the invention, in which the flat development of the tension spring's sheet is extended in the proximity of the tension spring's extremity designed to press on the bobbin thread, so as to make possible to bend such excess material with a bending radius towards the outside (with respect to the support means on which the tension spring is mounted and with respect to the main bending radius of the tension spring) and to leave unchanged the contact point of the tension spring with the bobbin thread. This different embodiment of the tension spring of FIGS. 8*a*-8*c* according to the invention, that considers to extend the flat development of the tension spring's sheet in proximity of the extremity of the tension spring designed to press on the bobbin thread, is easily achievable also for the other described embodiments of the tension spring, but the graphical representation is here omitted, as it would not be significantly different from FIGS. 9*a*-9*c* and 10*a*-10*c;*
Figure 11C:
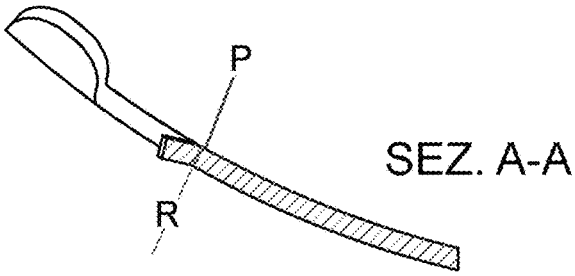
Figure 11A:
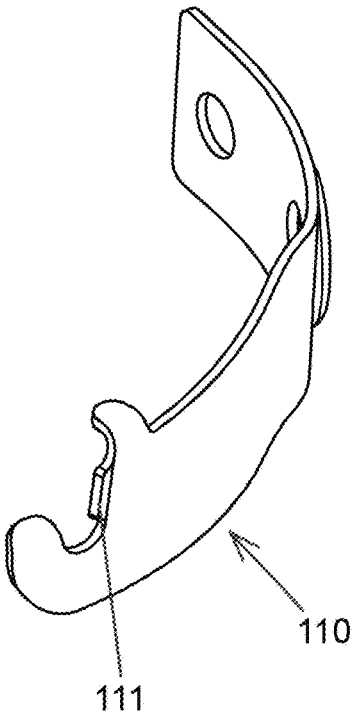
Figure 12B:
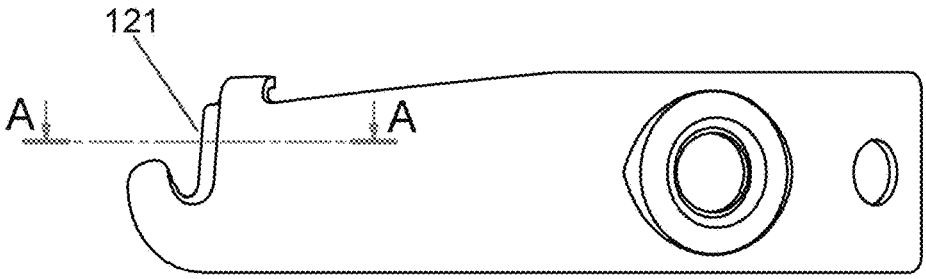
Figure 12C:
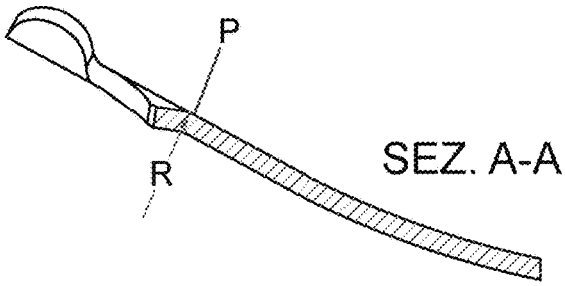
Figure 12A:
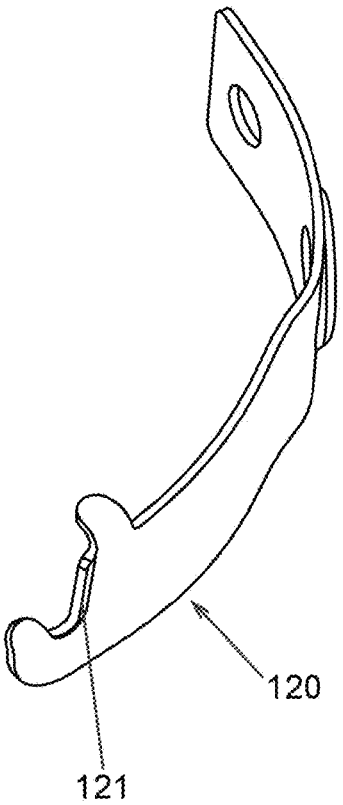
Figure 13A:
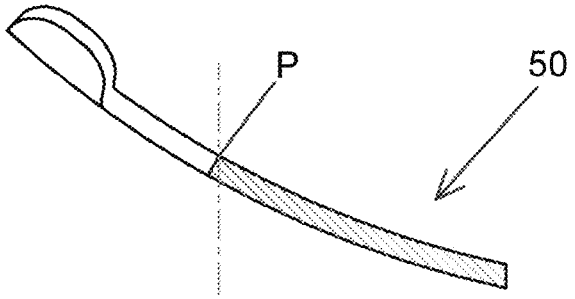
FIGS. 13*a*-13*c* show the mere detail in section along the section line A-A of FIGS. 5*b*, 8*b*, 11*b* of the point where the tension spring presses on the bobbin thread, by comparing a) the embodiment according to the state of the art in where the pressure point is on the edge of the sheet; b) the first embodiment according to the present invention in which the extremity of the tension spring is bent outwards generating a radius and moving back the point of pressure; c) the second embodiment according to the present invention in which the flat development of the tension spring has been extended so that when the additional material at the tension spring's extremity is bent towards the outside, the pressure point still remains the original one of the tension spring according to the state of the art.
Figure 13B:
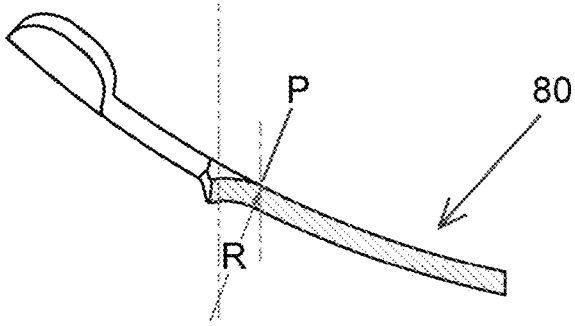
Figure 13C:
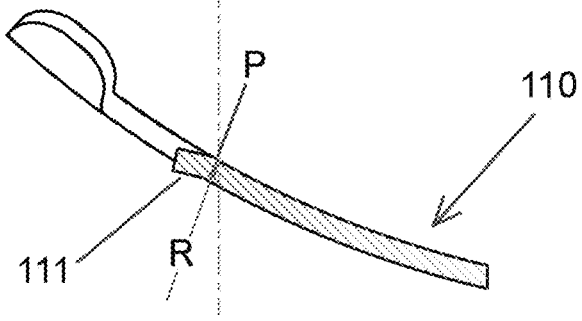

FIGS. 13*a*-13*c* show the mere detail in section along the section line A-A of the tension springs (50, 80, 110) of the previous FIGS. 5*b*, 8*b*, 11*b* of the point P where the tension spring presses on the bobbin thread, by comparing a) the embodiment of the tension spring 50 according to the state of the art where the pressure point is on the edge of the sheet; b) the first embodiment of the tension spring 80 according to the present invention in which the extremity of the tension spring is bent towards the outside generating a radius R and moving back the pressure point P with respect to the original one of the tension spring 50 according to the state of art; c) the second embodiment of the tension spring 110 according to the present invention in which the flat development of the tension spring has been extended so that when the additional material 111 at the tension spring's extremity is bent towards the outside, the pressure point remains in the same position as the original one of the tension spring 50 according to the state of the art. Entirely analogous considerations apply to other embodiments of the tension spring (60, 70).

In another preferred embodiment, said bending radius R towards the outside of the tension spring's extremity, opposite to the main bending radius of the tension spring (which is bent towards the inside of the support means on which it is mounted), is of a very small size and is less than 2 mm.

The hooks according to the invention, therefore, vary from those according to the state of the art (11, 12, 13, 14) only for the use of the tension spring (80, 90, 100, 110, 120) designed according to one of the preferred embodiments.

Naturally, the invention is not limited to the particular embodiments previously described and illustrated in the attached figures, but it can be subject to numerous modifications of detail within the reach of a person skilled in the art, without departing from the scope of the invention itself, as defined in the appended claims.

The invention claimed is:

1. A hook for a lockstitch sewing machine, comprising:

a tension spring mounted on a support, said tension spring being bent with a main bending radius towards an inside of said support, a bobbin on which a bobbin thread is wound, and at least one of a bobbin case and a basket of the hook, wherein said tension spring comprises an extremity configured to press on the bobbin thread, said extremity having an outward bending radius towards an outside, with respect to the support on which the tension spring is mounted and with respect to said main bending radius of the tension spring, so that a point of pressure on said bobbin thread is a point of tangency between said outward bending radius of the tension spring and said support, so as to generate a stable tension of the bobbin thread.

2. The hook according to claim 1, wherein said tension spring further comprises an extension of the tension spring, in proximity of said extremity of the tension spring, wherein said extension is bent towards the outside with said outward bending radius.

3. The hook according to claim 1, wherein said outward bending radius of the extremity of the tension spring, is less than the main bending radius.

4. The hook according to claim 1, wherein said outward bending radius of the extremity of the tension spring is less than 2 mm.

5. A tension spring belonging to a hook for a lockstitch sewing machine, said tension spring comprising:

a main bending radius towards an inside of the tension spring, an outward bending radius towards an outside, with respect to a support on which the tension spring is configured to be mounted and with respect to said main bending radius, wherein an extremity of the tension spring is designed to press on a bobbin thread, so that a point of pressure on said bobbin thread is a point of tangency between outward bending radius and said support of the tension spring.

6. The tension spring according to claim 5, wherein said tension spring further comprises an extension, in proximity of said extremity of the tension spring designed to press on the bobbin thread, and that said extension is bent towards the outside, with said outward bending radius.

7. The tension spring according to claim 5, wherein said outward bending radius of the extremity of the tension spring is less than the radius of the main bending radius.

8. The tension spring according to claim 5, wherein said outward bending radius of the tension spring is less than 2 mm.

9. The tension spring according to claim 5, further comprising the support of the tension spring belonging to a hook for a lockstitch sewing machine attached thereto.

10. The tension spring according to claim 5, further comprising a lockstitch sewing machine attached thereto.

11. The hook according to claim 2, wherein said outward bending radius of the extremity of the tension spring, is less than the main bending radius.

12. The tension spring according to claim 6, wherein said outward bending radius of the extremity of the tension spring is less than the main bending radius.

* * * * *